United States Patent [19]

Andres et al.

[11] Patent Number: 4,961,841

[45] Date of Patent: Oct. 9, 1990

[54] APPARATUS AND METHOD EMPLOYING MAGNETIC FLUIDS FOR SEPARATING PARTICLES

[75] Inventors: Uri T. Andres, London, United Kingdom; Alan L. Devernoe; Michael S. Walker, both of Schenectady, N.Y.

[73] Assignee: Mag-Sep Corporation, Guilderland, N.Y.

[21] Appl. No.: 335,129

[22] Filed: Apr. 7, 1989

Related U.S. Application Data

[63] Continuation of Ser. No. 869,397, Jun. 2, 1986, Pat. No. 4,819,808, which is a continuation of Ser. No. 380,753, May 21, 1982, Pat. No. 4,594,149.

[51] Int. Cl.[5] ..... B03B 5/32; B03C 1/00

[52] U.S. Cl. ..... 209/1; 209/214; 209/232

[58] Field of Search ..... 209/1, 3, 4, 8, 212, 209/214, 213, 219, 220, 232, 223.1, 211, 172.5, 12, 39, 40

[56] References Cited

U.S. PATENT DOCUMENTS

| | | | |
|---|---|---|---|
| 653,346 | 7/1900 | Gates | 209/212 |
| 1,527,069 | 2/1925 | Peck | 209/214 |
| 2,967,618 | 1/1961 | Vane | 209/211 |
| 3,279,602 | 10/1966 | Kothanstette et al. | 209/214 |
| 3,294,237 | 12/1966 | Weston | 209/214 |
| 3,483,968 | 12/1969 | Kaiser | 209/1 |
| 3,608,718 | 9/1977 | Aubrey et al. | 209/214 |
| 3,788,465 | 1/1974 | Reimers et al. | 209/1 |
| 3,951,785 | 4/1976 | Kaiser et al. | 209/1 |
| 3,966,590 | 6/1976 | Boom et al. | 209/232 X |
| 4,235,710 | 11/1980 | Sun | 209/232 X |
| 4,239,619 | 12/1980 | Aplan et al. | 209/214 |
| 4,746,422 | 5/1988 | Grimm | 209/211 |

FOREIGN PATENT DOCUMENTS

| | | | |
|---|---|---|---|
| 78392 | 9/1919 | Austria | 209/232 |
| 738814 | 7/1966 | Canada | 209/7 |
| 385623 | 2/1973 | U.S.S.R. . | |
| 649465 | 2/1979 | U.S.S.R. . | |
| 831189 | 5/1981 | U.S.S.R. . | |
| 1322229 | 5/1973 | United Kingdom . | |
| 1497769 | 1/1978 | United Kingdom . | |
| 2014062 | 8/1979 | United Kingdom . | |
| 7903697 | 8/1979 | United Kingdom | 209/1 |
| 2064377 | 7/1981 | United Kingdom . | |
| 7900622 | 9/1979 | World Int. Prop. O. . | |

OTHER PUBLICATIONS

Cohen et al., "The Principles and Operation of a Very High Intensity Magnetic Mineral Separator", IEEE Transactions on Magnetics, vol. 12, No. 5, 9-1976, pp. 525-535.

Eyssa et al., "A Feasibility Study Simulating Superconducting Magnetic Separators for Weakly-Magnetic Ores", Journal of Mineral Processing, 2-1975, pp. 235-248.

Reeve, "Magnetic Separation in Quadrupole Fields", Proceedings of the International Magnetic Technology Conference, 1977.

Li et al., "A Superconducting Magneto-Hydromechanical Separator", IEEE Transactions on Magnetics, vol. 17, No. 1, Jan. 1981.

Heck, "Magnetische Werkstoffe und ihre technische Anwendung", 1967, p. 28, Table 1.3.

Andres, "Magnetohydrodynamic & Magnetohydrostatic Methods of Mine Separation", 1976, pp. 13, 163-164.

*Primary Examiner*—Donald T. Hajec

*Attorney, Agent, or Firm*—Helfgott & Karas

[57] ABSTRACT

A magnetohydrostatic centrifuge of unique geometry in which an elongated separation space is provided within the bore of an elongate cylindrically shaped multipolar magnet. Separations are accomplished both with and without rotation by passing particles to be separated through the separation space within a paramagnetic or ferromagnetic fluid. Certain separations are preferably made using a quadrupolar magnet configuration with a paramagnetic fluid, others with a quadrupolar magnet and a ferromagnetic fluid, and still others, with a sextupolar magnet and a ferromagnetic fluid. Efficient use is made of the magnetic field through the use of a plurality of inner ducts creating a plurality of thin, elongate separation channels characterized by long particle dwell time and short drift distances during the separation process. Significant throughput capacity is achieved in a system in which the magnetic medium is pumped through the separator.

21 Claims, 3 Drawing Sheets

FIG. 2
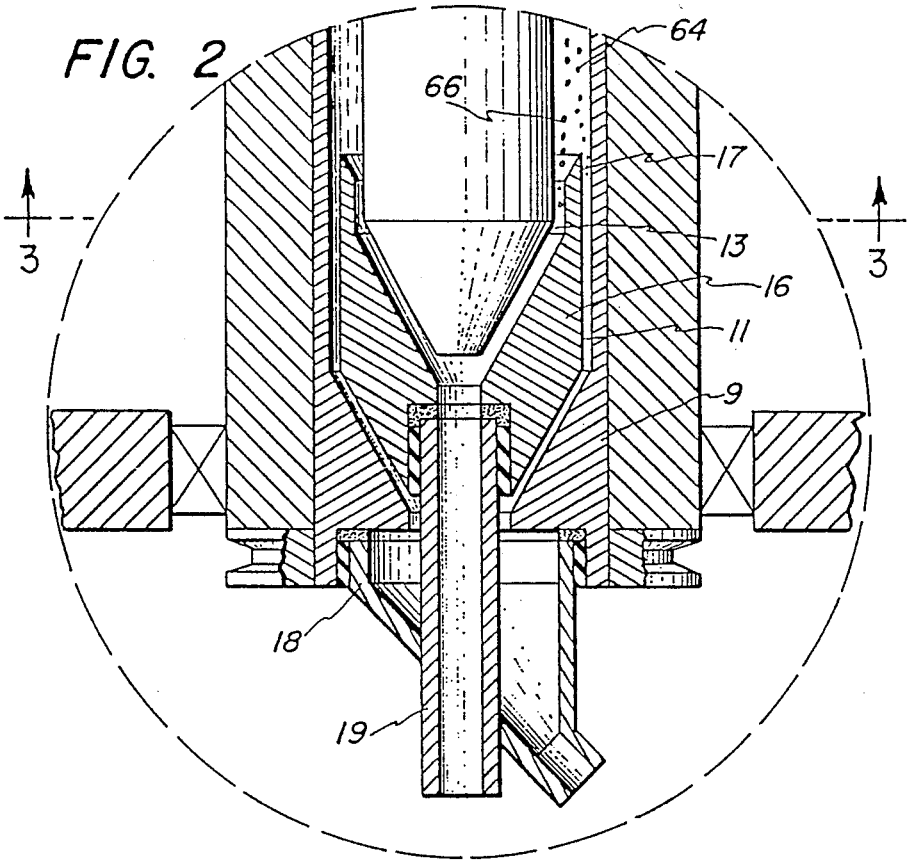
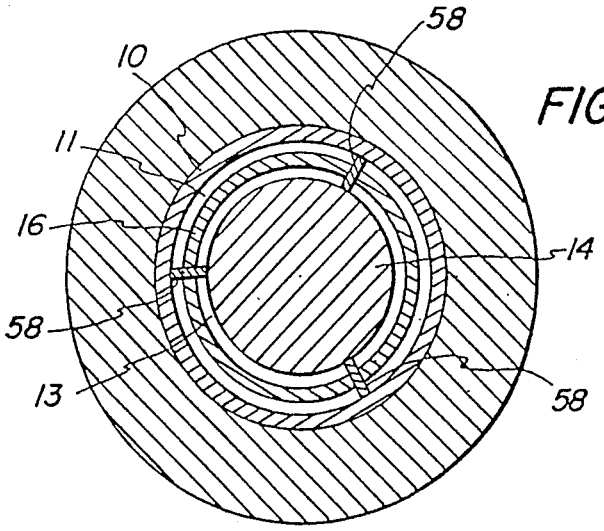
FIG. 3

APPARATUS AND METHOD EMPLOYING MAGNETIC FLUIDS FOR SEPARATING PARTICLES

This is a continuation, of application Ser. No. 869,397, filed on June 2, 1986, now U.S. Pat. No. 4,819,808, which was a continuation of application Ser. No. 380,753 filed on May 21, 1982 now issued as U.S. Pat. No. 4,594,149 on June 10, 1986.

BACKGROUND AND SUMMARY OF THE INVENTION

This invention relates to the separation of particulate matter on the basis of differences in magnetic susceptibilities, densities or both.

DEFINITIONS

The following terms and phrases are used hereinafter in accordance with the following meanings:

1. Particle to be Separated—Particulate matter, including solids and immiscible liquids.

2. Paramagnetic—Substances, solid or liquid, exhibiting relatively weak positive magnetic properties and which experience forces in a magnetic field which vary in accordance with the product of field strength and field gradient.

3. Ferromagnetic—Substances, both solid and liquid, exhibiting relatively strong positive magnetic properties and which experience forces in a magnetic field which vary only with the field gradient. The term is intended to include ferrimagnetic materials for present purposes because the overall behavior of such materials in our invention is similar to ferromagnetic materials.

4. Diamagnetic—Substances, both solid and liquid, exhibiting negative force proportional to the product of the field and field gradient.

5. Magnetic Fluid Medium—Any fluid substance exhibiting magnetic properties whether ferromagnetic, paramagnetic or diamagnetic. This includes suspensions of magnetic particles in liquids or gases.

g. Elongated—Having length substantially greater than width.

BACKGROUND OF THE INVENTION

There has traditionally been great interest in the development of new approaches for magnetic separation, particularly in approaches appropriate for the separation of ores. Major research has been directed towards the development of high gradient magnetic separation (HGMS), a technique which develops an enhanced local magnetic field in the immediate vicinity of a ferromagnetic screen or steel wool. This process is effective for the separation of more weakly magnetic materials than could formerly be treated magnetically, but its application is limited mainly to purification or trace removal requirements. Particles are trapped in the screen and must be washed free, a two-step process not well suited to the separation of large quantities of material as would be required for ores.

Other approaches have involved the further development of new, powerful superconducting magnets for use in direct magnetic attraction of particles using either conventional magnet geometries or new geometries. These direct attraction methods are mainly suited to an extension of the range of conventional magnetic separation to more weakly magnetic particles.

Yet another approach to magnetic separation of ores is known as magnctohydrostatic separation (MHS). Some investigators have concluded that MHS may be viable for scrap separation, but that its economic application to ore separation is questionable.

Nevertheless, we have discovered a new MHS centrifugal separator and method which permits separation on the basis of small differences in magnetic susceptibilities between even weakly magnetic materials or small differences in density or both. It permits separations which are not now practically feasible to the best of our knowledge. Also, separations can be achieved for very fine particles, even as small as about 1 micron. The throughput capability of our system is considerable and we believe the system can be successfully produced for commercial operation. Our system can operate in a very low range of magnetic susceptibility, a range heavily populated with valuable minerals, which is inaccessible for separation with conventional separation methods.

Briefly described, our system employs a specially designed separation duct surrounded by a multipolar magnet shaped so as to produce substantially only radially directed axisymmetric magnetic forces on materials within the duct. Particles to be separated are passed through the duct in a magnetic fluid medium and undergo radial magnetic forces dependent upon the relative effective magnetic susceptibilities of the fluid medium and the particles themselves. Means are provided for rotating the medium and the particles contained therein in order to create differential centrifugal forces based upon the density differences between the individual particles and between the particles and the medium. Thus, separations can be made without duct rotation on the basis of magnetic susceptibilities only, or they can be made with rotation on the bases of both density and susceptibility differences. Significant rates of throughput are achieved by using a plurality of concentric ducts which, in turn, create a plurality of relatively narrow, elongate annular separation channels. Separation channels of this configuration provide long dwell times as particles travel their length and short drift distances as the particles move radially during the separation process.

Special advantages are available through the use of certain combinations of magnet types and magnetic fluids. More specifically, we have found that the use of cylindrical, open bore quadrupolar magnets in combination with paramagnetic fluids are especially useful for many density separations because this combination in a centrifuge arrangement provides forces on the fluid which increase linearly with radial distance. Thus, separations based on density differences can be made cleanly for particles having magnetic susceptibilities within certain ranges. The same combination of magnet type and magnetic fluid is also particularly useful without rotation for many separations based only on differences in magnetic properties in the particles being separated. Yet, for certain other separations based only on magnetic properties, the combination of a quadrupolar magnet with a ferrofluid medium is more advantageous. We have also found that unique advantages for certain applications are available through the use of cylindrical, open bore sextupolar magnets in a centrifuge using a ferromagnetic fluid. In some cases, the use of a relatively low field strength is most desirable while in others, a relatively high field strength is best. With all of these combinations of magnet types and magnetic fluids, it is, of course, possible to adjust field strength and magnetic fluid properties and, where appropriate, rotational velocities to achieve optimum separation conditions. Further, we believe our new separator design can be employed in a system in which the magnetic fluid can be passed at sufficiently high rates to produce commercially significant throughput volumes.

The method of our invention is to establish an axially flowing column of a magnetic fluid medium within a magnetic field suitable for producing substantially only radially directed axisymmetric forces on magnetic materials contained within the column. Centrifugal forces may be selectively used for separations where differences in density are present by rotating the column. By means of the interplay of the differential magnetic and centrifugal forces on the particles, various separations can be made in accordance with pre-selected parameters. As noted above, certain separations are optimally made using quadrupolar magnets and a paramagnetic fluid, some being with rotation and others without. Another class of separation is best made with a quadrupolar magnet and a ferrofluid without rotation. Still other separations are advantageously made using a sextupolar magnet in combination with a ferromagnetic fluid in a centrifugal system. Of these, there are some for which the use of relatively low intensity field is appropriate while for others a high field is best.

BRIEF DESCRIPTION OF THE DRAWINGS

FIG. 2 is an enlarged view of a portion of the separator shown in FIG. 1.

FIG. 3 is a transverse cross-sectional view of the separator taken on line 3—3 of FIG. 2.

DETAILED DESCRIPTION OF THE DRAWINGS

Figure 1:
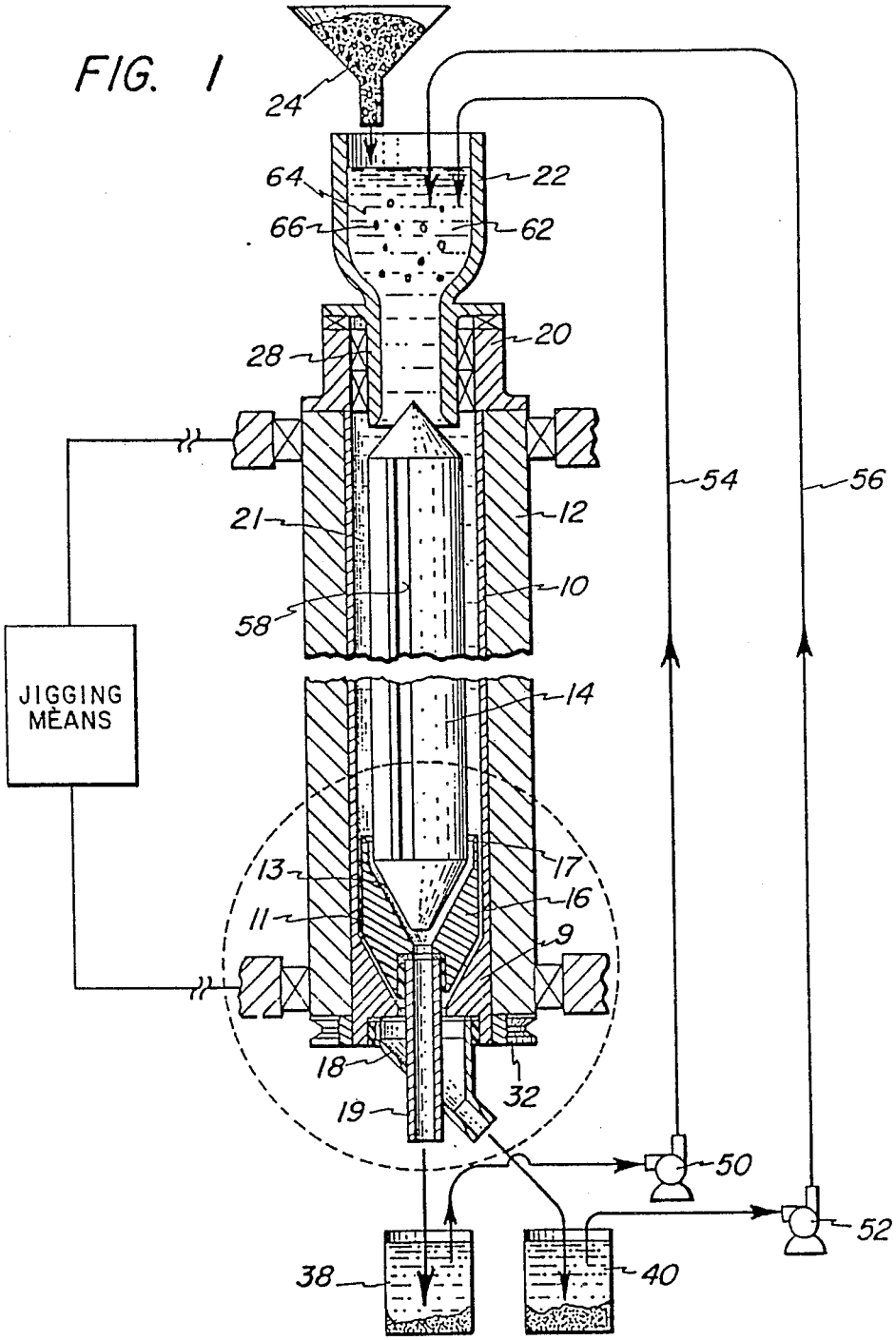
FIG. 1 is a schematic representation, partly in cross-section, showing an experimental system embodying the invention.

FIG. 1 shows an experimental embodiment of our invention in which a special separator duct 10 is centrally located within a cylindrically shaped multipolar magnet 12. A reception funnel 22 is provided for the introduction of ore or other material containing particles 64 and 66 to be separated as well as a magnetic fluid medium 62. Delivery tube 28 delivers the contents of funnel 22 to duct 10. A feed hopper 24 is positioned so that materials to be separated can be fed into funnel 22 in dry or wet form.

Figure 5:
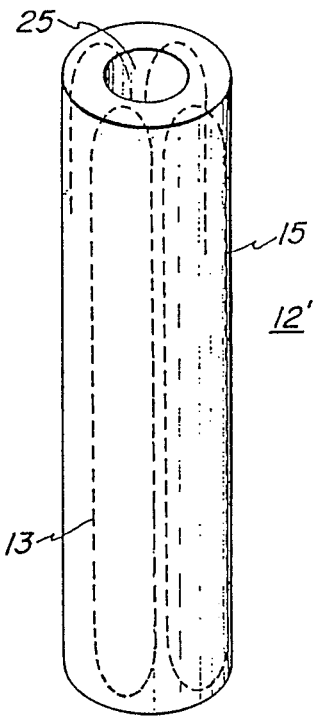
FIG. 5 is a schematic representation showing the manner in which a multipolar electromagnet could be wound for use in our separator.
Figure 6:
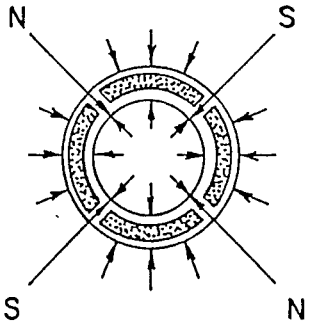
FIG. 6 is a schematic representation of the magnetic forces experienced by materials within the magnetic fields created by the magnets used in our invention.

Magnet 12 surrounds duct 10 and produces substantially only radially directed axisymmetric magnetic forces on materials contained within duct 10. For purposes of this application, the "separation duct" is understood to mean the duct in which the magnetic field of that character is created and in which the separation of particles takes place. Magnet 12 may be a permanent magnet or an electromagnet having either conventional or superconducting windings. Of course, if a superconducting magnet is used, it would be necessary to encase magnet 12 in a suitable, warm bore dewar, which for present purposes is not shown in FIG. 1. In the case of an electromagnet, the windings may be arranged as illustrated in FIG. 5. There, a quadrupolar magnet 12' is shown with windings 13 running in elongated longitudinal loops on a cylindrically shaped body 15 having an open central bore 25. Those skilled in the art will appreciate that the magnetic field created by this arrangement, both inside and outside of the magnet, will produce substantially only radially directed axisymmetric forces on materials therein. These forces are illustrated schematically in FIG. 6 wherein the north and south poles are designated by the letters N and S, respectively. The direction of forces experienced upon particles having positive magnetic susceptibilities is indicated by the arrows. Those skilled in the art will also appreciate that for relatively long magnets, these forces are substantially only radially directed throughout most of the magnet length, except for areas near the ends of the magnet. It will also be appreciated that such forces are axisymmetric for a magnet having a cylindrical shape. Although not illustrated, forces of the same character with respect to direction and symmetry can likewise be created with a sextupolar magnet of similar geometry in which north and south poles are alternately arranged around its central axis.

Referring again to FIG. 1, it will be seen that a septum 16 is provided near the lower end of duct 10, duct 10 being shown in a substantially vertical position. The purpose of septum 16, as shown more clearly in FIG. 2, is to physically divide the useful cross-sectional area of duct 10 into inner and outer fraction conduits 13 and 11, respectively. For this purpose, septum 16 is equipped with a knife-edge 17 or other dividing edge at its upper extremity where this physical separation begins.

FIG. 1 also shows a central longitudinal flow guide 14 which is held in place within duct 10 by three vanes 58, more clearly shown in FIG. 3. The purpose of flow guide 14 is to direct the medium 62 and the particles 64 and 66 away from the central portion of duct 10 as those particles move downwardly through the separator. This is desirable because the magnetic and centrifugal forces developed on or about the central axis of duct 10 are either non-existent or so small that they tend to be of relatively little use. By directing the flow of particles into the more outward regions of duct 10, use is made of the stronger forces which are available there in order to make more efficient use of the working volume of magnet 12.

It may be observed in FIG. 2 that outer fraction conduit 11 leads into outer fraction collection tube 18 while inner fraction conduit 13 leads to inner fraction collection tube 19. These tubes are fed into separated product collection containers 38 and 40 illustrated schematically in FIG. 1. There, they are separated from the magnetic fluid medium 62 by any conventional means such as an appropriate filtering system. The filtering system is desirably effective to sufficiently cleanse and recondition medium 62 so that it may be recycled through lines 54 and 56 as shown. Peristaltic pumps 50 and 52 are provided in lines 54 and 56, respectively, so that the flows can be adjusted in outer fraction conduit 11 and inner fraction conduit 13 for optimum efficiency in accordance with a particular separation being made. The system can, of course, be operated with open flow without recovery and recycling of magnetic fluid 62.

Rotation of the medium 62 and particles 64 and 66 is accomplished in our preferred embodiment by rotation of duct 10 and magnet 12. Vanes 58 are guide 14 rotates therewith. Septum 16 is rigidly connected to guide 14 and is journaled at its connection with inner fraction collection tube 19. Likewise, duct 10 terminates in an enlarged portion 9 which is journaled at its connection with outer fraction collection tube 18. Rotation is imparted to the assembly by means of drive pulley 32 at the bottom of magnet 12. Drive pulley 32 is connected to a suitable variable speed motor by means of a drive belt, these latter structures not being shown. Reception funnel 22 may be journaled in upper swivel 20 so that it may be restrained from rotating with magnet 12 and duct 10 when desired.

Since the separation duct 10 and the magnetic field created therein are elongate, the particles are given substantial dwell time within the magnetic field so as to provide clean separations even at high rates of flow. An additional advantage of this configuration is that the lateral drift to be negotiated by the particles as they pass through the magnetic field is relatively short. A mathematical description of the separation process in the centrifugal mode of operation and its relationship to duct design is given below.

As shown in FIG. 1, the central axis of the separation duct is vertically oriented. Also, the central axis of the cylindrically shaped multipolar magnet 12 is vertically oriented and coincident with the axis of separation duct 10. In this orientation, the particles can be allowed to fall by gravity through the separation duct.

The invention can be operated in two basic modes, one in which the medium and the particles contained therein are rotated and the other in which they are not. A flowing or stagnant medium and particles can be utilized in either mode.

When the system is operated without duct rotation, separation of particles can be made into two fractions based upon the difference in their magnetic susceptibilities. In this mode of operation, it is necessary to choose a magnetic fluid medium 62 whose susceptibility lies between the magnetic susceptibilities of the two groups of particles to be separated. Under those conditions, particles with a greater susceptibility will be attracted radially outwardly as they pass through separation duct 10, thus becoming outer fraction particles 64 to be collected between septum 16 and duct 10. Particles having a magnetic susceptibility lower than that of medium 62 will be buoyed inwardly and collected within septum 16. It should be noted that if the medium is a ferromagnetic suspension, it will have an effective magnetic susceptibility equal to its magnetization per unit volume divided by the magnetic field strength. This is, of course, true of any ferromagnetic substance.

Additional separations can be made in the other basic mode of operation in which duct 10 is rotated. In this mode, the susceptibility of the magnetic fluid medium 62 is chosen so that it exceeds that of at least some or all the particles to be separated. In this instance, if the susceptibilities of the particles to be separated are reasonably close to one another, separations can be performed on the basis of differences in density. Since some or all of the particles are buoyed inwardly, it is possible to adjust the angular velocity of the duct so that at least some of the heavier particles will be driven outwardly by centrifugal force. In other words, the centrifugal force on these particles will exceed the inwardly directed magnetic buoyancy force on them, if any. By using a relatively weak magnetic field, say about 5000 oersteds (a strong field being about 50,000 oersteds), and a strongly magnetic fluid, the susceptibilities of weakly magnetic particles will have only a small influence on the separation, and separations based primarily on density differences can be achieved even for particles having significantly different magnetic susceptibilities. The use of a sextupolar magnet, for example, in combination with a ferromagnetic fluid is especially useful in such cases, as will be seen more clearly from the examples given hereinafter.

It should be noted that separation into a plurality of fractions becomes possible in the rotational mode of operation. To accomplish this, it would be necessary to adjust the shape of the magnetic field so as to provide equilibrium positions for particles of various densities.

In either of the above-described modes of operation, the throughput of the system can be increased by causing the medium 62 and particles contained therein to pass downwardly through duct 10. The only limitation on the linear velocity of the medium relates to dwell time. The particles to be separated must have sufficient time in the magnetic field to permit them to be driven to their desired radial positions. Thus, duct 10 is desirably an elongate duct so as to provide adequate dwell times at reasonably high throughput levels.

MATHEMATICAL DESCRIPTION OF THE SEPARATION PROCESS IN THE CENTRIFUGAL MODE

The choice of magnet configuration, field strength, angular velocity, and duct design is based upon calculation of the forces to which the particles are to be subjected. These forces, of course, vary with the magnetic susceptibilities and densities of the particles themselves. They are also dependent upon the magnetic properties and the density of the fluid medium.

Consider the case of a paramagnetic fluid in combination with a quadrupole magnet. Let Particle #1 have magnetic susceptibility per unit volume $\kappa_1$, density $\rho_1$ and drag for movement through the fluid, $D_1$ and Particle #2 with magnetic susceptibility $\kappa_2$, density $\rho_2$ and drag, $D_2$. The fluid has density $\rho_f$ and magnetic susceptibility $\kappa_f$. The maximum time required for Particle #1 to move from the inside radius $r_i$ to the septum (divider) radius $r_s$ is $$\tau_1 = \frac{D_1}{F_1} \ln \frac{r_s}{r_i} r_o \tag{1}$$

where $$F_1 = r_o[\Delta H^2(\kappa_1 - \kappa_f) + (\rho_1 - \rho_f)\omega^2] \tag{2}$$

$r_o$ is the outside radius of the duct, $\Delta H$ is the magnetic field gradient, and $\omega$ is the angular velocity of slurry rotation in radians/sec.

Similarly $$\tau_2 = \frac{-D_2}{F_2} \ln \frac{r_s}{r_o} r_o \tag{3}$$

for Particle #2 to move from outside radius $r_o$ to the septum radius, where $$F_2 = r_o[\Delta H^2(\kappa_2 - \kappa_f) + (\rho_2 - \rho_f)\omega^2] \tag{4}$$

For best duct design $\tau_1 = \tau_2 = \tau$ and $$\omega^2 = \frac{-\Delta H^2 \frac{(\kappa_1 - \kappa_f)}{D_1} + \frac{(\kappa_2 - \kappa_f)}{D_2}}{\frac{(\rho_1 - \rho_f)}{D_1} + \frac{(\rho_2 - \rho_f)}{D_2}} \quad (5)$$

For $D_1 = D_2$ and minimum $\tau$, $\tau_1 = \tau_2$ gives $$r_s = (r_o r_i)^{\frac{1}{2}} \text{ (a condition for duct design)} \quad (6)$$

and $$\omega^2 = \frac{-\Delta H^2 (\kappa_1 + \kappa_2 - 2\kappa_f)}{(\rho_1 + \rho_2 - 2\rho_f)} \text{ (a condition for operation)} \quad (7)$$

For small spherical particles $$D = \frac{18\,\eta_{eff}}{d^2},$$

where d is the particle diameter and $\eta_{eff}$ is an effective viscosity depending upon the solids concentration. The combined vertical flow and drift velocity should be adjusted to allow total particle dwell time, $\tau_{min}$, for the smallest particle and largest $\Delta\rho$ or $\Delta\kappa_2$ to be acceptable. That is $$(v_{flow} + v_{drift}) = \frac{L}{\tau_{min}} \quad (8)$$

where L is the magnetic field length, and $v_{drift}$ is the vertical velocity of the particles relative to the fluid due to gravity.

$$v_{drift} = \frac{g(\rho - \rho_{fluid})}{D} \quad (9)$$

The throughput is given by the equation $$T = A\,(v_{flow} + v_{drift}) \quad (10)$$

where A is the flow cross-section of the duct. The throughput can be calculated by substitution of (5) into (2), (2) into (1), (1) into (8), and (8) into (10). Analyses similar to the foregoing can be performed for a ferromagnetic fluid and sextupole magnet or other combinations of fluids and multipoles.

From the foregoing, it is clear that particles in a vertically oriented separation duct in which substantially only radially directed axisymmetric magnetic and centrifugal forces are present will be separated into annular fractions. If multipolar magnet 12 is cylindrically shaped, the forces on the particles will depend only on radial position. However, there may be some applications in which "jigging" or the application of a superimposed alternating force would be advantageous. This can be accomplished in a variety of ways. One could, for example, intentionally misalign the separation duct 10 and the magnet 12 with the vertical. Alternatively, one might separate the central axis of the duct from that of magnet 12. A further alternative would be to impart a non-circular shape to the magnetic forces by using ferromagnetic or other suitable materials to reshape the magnetic field somewhat. Or one could simply vibrate the contents of duct 10. By doing such things, particles undergoing separation in the rotational mode will experience jigging because of the superimposed cyclically varying forces. It is believed that this would be of advantage in driving the particles through slurries, particularly where the solid loading is high, because the particles would be jostled about, thus promoting the separation process.

Figure 4:
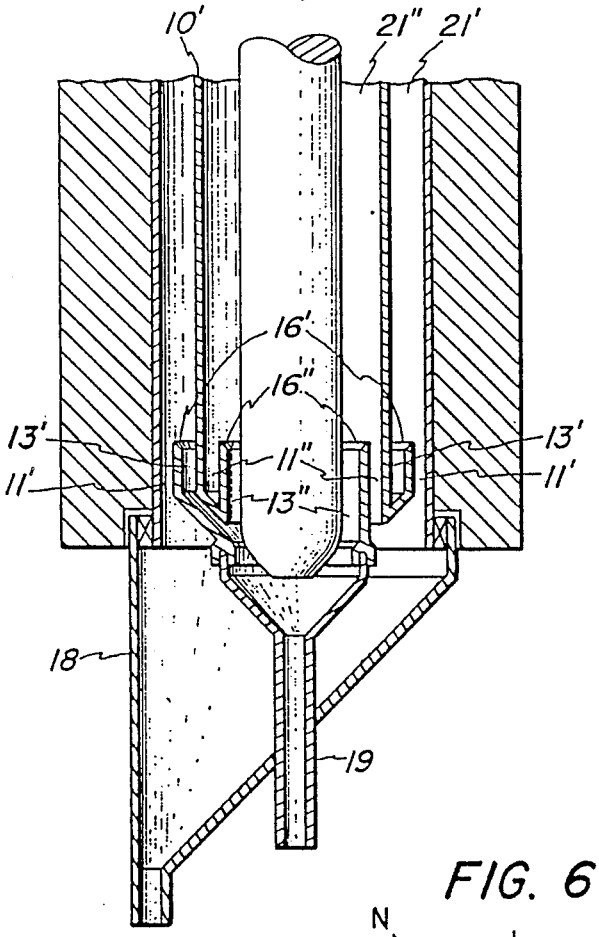
FIG. 4 shows an alternate embodiment of the separator duct employing multiple separation channels.

FIG. 4 shows an alternate embodiment of our separation duct which is preferred. Essentially, the purpose of the illustrated structure is to subdivide the useful space within separation duct 10 into a plurality of separation channels 21' and 21'' or annular sub-columns. The reason for doing this is to shorten the radial distance particles must travel in the separation process. The resulting separation channels 21' and 21'' are quite elongate and thin. The relatively long dwell times thus provided, coupled with the short drift distances required for separation, make the separator more efficient, thus making better use of the available magnetic force provided by magnet 12. As shown, outer fraction conduits 11' and 11'' both feed into outer fraction collection tube 18. Similarly, inner fraction conduits 13' and 13'' both feed into inner fraction collection tube 19.

FIG. 4 is intended to be illustrative only. It should be understood that the number of channels like 21' and 22' might be considerably more than two. Using mathematical analysis like that set forth above, one can compute the optimum number and size of separation channels, considering the loss of useful separation space resulting from the cumulative thickness of the duct walls. Also, we believe that there are alternative means for creating the condition of short particle radial travel under the radial forces by dividing up the space within the duct. For example, one can create a series of concentric annular ducts with small radial thickness. Alternatively, one could construct a single duct comprised of a tightly co-wrapped spiral of inner and outer duct walls and septum. To include this possibility and other divisions of the separation space that accomplish the same end, we refer to such a sub-division of the separator space as "substantially concentric and substantially annular" in the claims which follow.

Examples

In the course of our investigation, we constructed two laboratory separators having the general configuration depicted in FIG. 1. A description of these devices is presented in Sections A and B which follow. Separations were performed with these separators on real ores and on two-component mixtures of minerals prepared to simulate different separation problems. Usually the minerals in these mixtures were selected on the basis of distinct color, crystal shape and density differences, so that the separations would be amenable to visual interpretation and results could be clearly presented. Some of the separations of the mixtures are presented in Sections A and B and Table 1, set forth below, as examples of the capabilities of this invention. Note that all results are very good, especially considering that they were each achieved in a single pass of the material through the separator. (Grade and recovery refer to that constituent expected to be mainly present in the inner or outer fraction.)

A. Separations with the First Laboratory Separator.

The first laboratory separator was constructed using a cylindrical superconducting quadrupole magnet having a 2.75 inch diameter cold bore, an 8-inch useful length and an operating range up to 2.5 Tesla with a 13 kiloGauss per inch gradient. The magnet was located within a 60-inch-long cryogenic containment dewar having an outside diameter of 12 inches and a warm bore of 1-7/16 inches. Several separation ducts were constructed for operation in this device.

The first separation duct was fabricated with a closed bottom from clear polycarbonate. An internal septum was provided for fraction sample collection. In operation, the duct was installed in the warm bore of the dewar and rotated from the top by a variable speed drive motor. Experiments were performed using a static fluid column with hand-feeding of minerals into the top of the delivery tube. The minerals would fall through the fluid approximately 4 feet before they entered the 8-inch-long region of magnet influence of lateral magnetohydrostatic separation forces, reorient themselves radially, and fall into separate concentric collection zones created by the septum.

The results of two of the separations performed with the above apparatus are shown as Examples #1 and #2 in Table 1. The first example illustrates the capability for separation of fine particles by differences in density using our MHS centrifuge. The second example illustrates use of the device in the alternate mode, where separation is achieved by differences in magnetic properties without fluid rotation. To our knowledge, the high quality example separation (of two weakly magnetic minerals having a clear difference in magnetic susceptibility that is small compared to the susceptibility of either constituent) cannot be achieved by any other magnetic separation method, conventional, high intensity or high gradient.

Another separation duct, modified for different presentation of slurry feed into the separation zone, was used to successfully demonstrate separations with a flow of the slurry through the separator using an arrangement like that shown in FIG. 1. This duct provided a thin ($\frac{1}{4}$-inch-wide) annular flow space for the fluid-particle slurry, demonstrating the separation in a thin elongated separation region. This duct, together with the quadrupolar field configuration and paramagnetic fluid, represents one of the preferred manifestations of the MHS centrifuge concept. One separation in this duct, Example #3, illustrates the ability of our MHS centrifuge to operate with flow of the fluid-particle slurry and to separate materials on the basis of a small difference in particle densities, in this case only 0.5 g/cc. Example #4 illustrates the ability of the device to achieve quality separations under conditions simulating practical levels of throughput: that is, for a high velocity of slurry flow (33 feet-per-minute) at practical levels of solids concentration (6% by volume). The example here is for the alternate case of separation by differences in magnetic properties, but similar throughputs should result for separations by magnetic properties as well.

Example #5 illustrates that the difficult separation of Example #2 (by weak magnetic susceptibility differences) can also be achieved with a ferromagnetic fluid and under conditions of slurry flow.

B. Separations with the Second Laboratory Separator

It became apparent to us that many ores exhibit a variable magnetic characteristic in the concentrate and the gangue that interferes with separation based on density. For these cases, an MHS centrifuge device using a low field is preferred because it is relatively insensitive to the magnetic characteristic of the particles. The stronger, ferromagnetic fluid is also desirable to achieve the inward magnetic buoyancy force levels required. Consequently, a one-meter-long, 2-inch bore MHS centrifuge separator was designed and constructed using samarium cobalt permanent magnets in a sextupolar configuration. The magnets produced 0.398 Tesla at the 2-inch-diameter with a gradient of 7.36 kiloGauss per inch. To save space, the separator was designed so that the magnet assembly would rotate with the duct.

Example #6 provides an illustration of the capability of this device for the type of separation for which it was designed; i.e., density difference separations where variable magnetic characteristics in the concentrate and in the gangue would normally confuse the separation. It is also an example of the use of a sextupole magnet with the ferrofluid, one of the preferred manifestations of our MHS centrifuge concept. A light magnetic mineral was cleanly separated, by density, from a non-magnetic, heavy mineral. Analysis of the separated products shows a 98.5% (Pyrite) grade concentrate and a 5.6% (Pyrite) grade tailing. Recovery of the Pyrite calculates to 98.5% for this separation.

TABLE 1

Examples of Single Pass Separations of Minerals Performed with Laboratory Models of the Invention

| | Mineral Mixture | | | | Conditions | |
|---|---|---|---|---|---|---|
| Example # and Purpose | Minerals, Sizes and Amounts | Densities and Susceptibilities ($10^{-6}$ emu/cc) | Fluid Name Property and Value | Magnet Configuration and Construction | Rotation, Field, Field Gradient at Septum Radius | Results |
| 1. Sep.* of fine particles by density diff.** (no flow) | 33% fluorite<br>$44\mu < d < 74\mu$<br>67% galena<br>$44\mu < d < 74\mu$ | $\rho = 3.2$ b/cc<br>$\kappa \simeq -0.9$<br>$\rho > 7.0$ g/cc<br>$\kappa \simeq -0.5$ | $MnCl_2$<br>Paramagnetic<br>$\kappa = 64 \times 10^{-6}$ emu/cc | Quadrupole, Superconducting | 180 rpm,<br>3909 Oe,<br>4478 Oe/cm<br>0.87 cm | over 95% recovery and grade in dense and light fractions |
| 2. Sep. of two weakly magnetic minerals by $\kappa$ (no flow) | 50% diopside<br>$150\mu < 0 < 300\mu$<br>50% epidote<br>$150\mu < d < 300$ | $\rho = 3.3$ g/cc<br>$\kappa = 28$ to 50<br>$\rho = 3.4$ g/cc<br>$\kappa = 75$ to 116 | $Mn(NO_3)_2$<br>Paramagnetic<br>$\kappa = 70 \times 10^{-6}$ emu/cc | Quadrupole, Superconducting | 0 rpm,<br>3875 Oe,<br>4439 Oe/cm<br>0.87 cm | Over 90% recovery and grade in more and less magnetic fractions |
| 3. Sep. of two materials by small density diff. (flow) | ~50% aluminum<br>$150\mu < d < 350\mu$<br>~50% fluorite<br>$300\mu < d < 600$ | $\rho = 2.7$ g/cc<br>$\kappa \simeq 1.6$<br>$\rho = 3.2$ g/cc<br>$\kappa \simeq -0.9$ | $MnCl_2$<br>Paramagnetic<br>$\kappa = 68 \times 10^{-6}$ emu/cc | Quadrupole, Superconducting | 221 rpm,<br>3728 Oe,<br>3358 Oe/cm<br>1.11 cm | 91% aluminum grade in light fraction at 94% recovery |
| 4. Sep. at high slurry flow (33 ft/min) and solids concentration (6% by volume) | 33% fluorite<br>$150\mu < d < 300\mu$<br>67% epidote<br>$150\mu < d < 300\mu$ | $\rho = 3.2$ g/cc<br>$\kappa \simeq -0.9$<br>$\rho = 3.4$ g/cc<br>$\kappa = 75$ to 116 | $MnCl_2$<br>Paramagnetic<br>$\kappa = 42 \times 10^{-6}$ emu/cc | Quadrupole, Superconducting | 0 rpm,<br>5356 Oe,<br>4325 Oe/cm<br>1.11 cm | Over 90% recovery and grade in more and less magnetic fractions |
| 5. Sep. of two weakly magnetic minerals by $\kappa$ | 67% diposide<br>$150\mu < d < 300\mu$<br>33% epidote | $\rho = 3.3$ g/cc<br>$\kappa = 28$ to 50<br>$\rho = 3.4$ g/cc | Aqueous ferromagnetic liquid | Quadrupole, Superconducting | 0 rpm,<br>4177 Oe,<br>3764 Oe/cm | 93% diopside grade with 94% recovery |

TABLE 1-continued

| Examples of Single Pass Separations of Minerals Performed with Laboratory Models of the Invention | | | | | | |
|---|---|---|---|---|---|---|
| | Mineral Mixture | | | | Conditions | |
| Example # and Purpose | Minerals, Sizes and Amounts | Densities and Susceptibilities ($10^{-6}$ emu/cc) | Fluid Name Property and Value | Magnet Configuration and Construction | Rotation, Field, Field Gradient at Septum Radius | Results |
| (flow) | $150\mu < d < 300\mu$ | $\kappa = 75$ to 116 | m = 0.24 emu/cc | | 1.11 cm | |
| 6. Sep. of a magnetic light from a non-magnetic dense (flow) | 60% epidote<br>$74\mu < d < 150\mu$<br>40% pyrite<br>$74\mu < d < 150\mu$ | $\rho = 3.4$ g/cc<br>$\kappa = 75$ to 116<br>$\rho = 5.1$ g/cc<br>$\kappa \simeq 1$ | Aqueous ferromagnetic liquid<br>m = 1.91 emu/cc | Sextupole, Permanent Magnet | 238 rpm,<br>3480 Oe,<br>2933 Oe/cm<br>2.38 cm | 98.5% pyrite recovery in 98.5% pyrite grade |

*separation; **differences

In addition to the foregoing experiments, we have performed others on a similar apparatus which indicate an ability to separate on the basis of small density differences or on the basis of a difference in magnetic susceptibility as small as about $25\times10^{-6}$ emu/cc. Separations for slurry concentrations of up to 23% solids by weight with fluid flow velocities of up to 33-feet-per-minute.

Our work has demonstrated that it is advantageous to use the combination of a paramagnetic fluid and a quadrupolar magnet for certain density separations and the combination of a ferrofluid and a sextupolar magnet for other density separations. Both combinations yield linearly increasing forces on the magnetic fluid medium 62 with radial distance from the axial center to the wall of separation duct 10. The ferrofluid/sextupole combination, however, offers special advantages where separations are to be made on the basis of relatively small density differences in materials having a range of magnetic susceptibilities. As noted earlier, density separations are most easily made when the magnetic susceptibilities of the fractions to be separated are the same or, at least, within a very narrow range. For many applications, the paramagnetic/quadrupolar combination is adequate. But when the range of magnetic susceptibilities becomes somewhat larger, for example, where the spread in susceptibilities is greater than about $30\times10^{-6}$ emu/cc, and where these susceptibilities are spread throughout the gangue of an ore as well as among the valuable minerals to be extracted, it becomes necessary to mask the effects of magnetic susceptibilities. Otherwise, separations will occur on the combined bases of susceptibilities and densities, rather than on the basis of densities alone, as is desired, with the result that the separation would not be particularly clean. With the ferrofluid/sextupole combination, the effective susceptibility of the fluid tends to be higher than that of the constituents of an ore to be separated. Thus, substantial inwardly directed buoyancy forces can be created on all constituents of the ore while selected components thereof can be driven outwardly by centrifugal forces with sufficiently high rotational velocity of the fluid, mainly independent of particle magnetic susceptibilies.

What has been demonstrated by the foregoing is a novel apparatus and method for separating particles in which relatively small differences in density can be used to develop bipolar separation forces at many times the force of gravity. Also, the efficient use of the magnetic field allows the use of less concentrated and less expensive fluids at practical levels of throughput.

A similar advantage results for separation by small magnetic differences in weakly magnetic materials. At the present time, for example, high intensity magnetic separation can only be used to collect minerals having magnetic susceptibilities of about $200\times10^{-6}$ emu/cc or higher, such as wolframite, garnet or chromite. With our separator, however, we can not only collect, but we can actually separate particles from one another on the basis of small differences in magnetic susceptibilities on the order of $10\times10^{-6}$ to $1\times10^{-6}$ cmu/cc. Such separations, so far as we know, have not previously been possible and have been regarded by most investigators as unlikely possibilities.

The invention described above clearly has broad application, although it may be employed with various modifications. For example, in its rotational mode of operation with flow of the medium, it is not always necessary to orient the separation duct so that its longitudinal axis is parallel with the lines of force in a gravitational field. Also, those skilled in the art will realize that many of the separations described above can be performed outside the cylindrical magnet, although we believe it is more convenient to do so inside. Nevertheless, it is theoretically possible to build an MHS centrifugal separator with its separation channels surrounding the magnet with the use of a diamagnetic fluid medium. Other modifications can be made concerning rotation of the magnetic fluid medium and the particles contained therein. For example, the vanes 58 on flow guide 14 can be designed in a spiral configuration so that fluid pumped therethrough will undergo a swirling action as it descends through the separator. Also, jigging might be accomplished by superimposing another magnetic field on the basic field provided by magnet 12. Conceivably, an entirely different magnetic source field could be used in place of magnet 12, the basic requirements being the production of radially directed axisymmetric separation forces without substantial axial components. Clearly, all such designs and modifications are within the spirit of this invention, the scope of which is intended to be limited only by the appended claims.

What is claimed is:

1. A method of separating a collection of particles in a gravitational field on the basis of differences in their magnetic properties and independent of their density properties, comprising the steps of:

(a) establishing an annular separation column of a ferromagnetic fluid medium having preselected magnetic properties, said column having a central axis and said axis being substantially aligned with the lines of force in the gravitational field;

(b) permitting the particles to be separated to fall through the medium under the influence of the gravitational field;

(c) establishing within the annular column substantially about its axis an elongated magnetic field having sufficiently high field gradient to separate at least two groups of particles having even small magnetic differences, and of such configuration as to produce substantially only radially directed axisymmetric forces on the ferromagnetic medium and the particles to be separated as the particles fall through the medium, the width of the separation annulus, the magnetic properties of the ferromagnetic field medium and the type of magnetic field having been selected such that the amount of magnetization per unit volume of the medium divided by the magnetic field strength produces an effective magnetic susceptibility of the ferromagnetic medium of sufficient narrow range and between that of the two groups of particles to be separated so that the particles of one group are urged radially inwardly and those of another group are urged radially outwardly to form inner and outer fractions, respectively; and (d) separately collecting the inner and outer fractions of particles.

2. The method of claim 1 further comprising the step of:

(e) separately collecting particles contained within predetermined substantially concentric and substantially annular segments of the particles as they leave the separation column.

3. The method of claim 1 wherein the magnetic field establishing step is accomplished by means of an elongated annular multipolar magnet.

4. The method of claim 3 wherein the magnet surrounds the column.

5. The method of claim 4 wherein the magnet is a quadrupole.

6. The method of claim 5 wherein the magnet is a sextupole and the distance between the inner and outer boundary is small.

7. The method of claim 1 wherein the particles are in the ferromagetic medium in the form of a slurry.

8. The method of claim 7 wherein the slurry is a flowing stream introduced into the separation column.

9. The method of claim 1 wherein said column is elongated.

10. The method of claim 1 wherein said annular column has an inner and an outer boundary and wherein the particles of the one group are urged toward the inner boundary and those of the another group are urged toward the outer boundary.

11. The method of claim 1 wherein the ferromagnetic fluid medium has a density less than all of the particles.

12. Apparatus for separating a collection of particles in a gravitational field on the basis of differences in their magnetic properties and independent of their density properties comprising:

an annular separation duct with a predetermined cross-section for receiving and holding a magnetic fluid, said duct having a central axis adapted to be aligned with the lines of force in a gravitational field and said duct having a bottom and an open top;

means for establishing a magnetic field having sufficiently high gradient to separate at least two groups of particles having even smaller magnetic differences, said field being suitable for producing substantially only radially directed axisymmetric magnetic forces on materials contained therein;

said magnetic fluid comprises a ferromagnetic fluid medium contained within the duct and having such magnetic properties as compared with those of the particles that, when in the magnetic field with the particles, and within the separation annulus the amount of magnetization per unit volume of the ferromagnetic medium divided by the magnetic field strength produces an effective magnetic susceptibility of the ferromagnetic medium of sufficiently narrow range and between that of the two groups of particles to be separated, and the particles of one group are urged radially inwardly and those of another group are urged radially outwardly to form inner and outer fractions, respectively;

means for introducing the particles to be separated into the duct so as to permit them to fall therethrough from top to bottom under the influence of a gravitational field; and means for separately collecting the inner and outer fractions of particles at the bottom of the duct.

13. The invention of claim 12 wherein the magnetic field establishing means is comprised of a quadrupolar magnet surrounding the axis outside the duct.

14. The invention of claim 12, wherein the magnetic field establishing means is comprised of sextupolar magnet surrounding the axis outside the duct.

15. The invention of claim 12, wherein the duct includes means for forming therein a plurality of annular subcolumns and wherein the collecting means is effective to collect radially inner and outer fractions of particles from each subcolumn.

16. The invention of claim 12, and further comprising stream establishing means for establishing a slurry of the particles in the ferromagnetic fluid medium and for introducing the flow of slurry into the duct.

17. The invention of claim 12, wherein the magnetic field establishing means surrounds the duct.

18. The invention of claim 12, wherein the invention further includes means for recirculating the fluid back to the stream establishing means for repeated passes through the apparatus.

19. The invention of claim 12, wherein the duct is elongated.

20. The invention of claim 12, wherein the duct includes an inner and an outer boundary, and wherein the particles of the one group are urged toward the inner boundary and those of the another group are urged toward the outer boundary.

21. The invention of claim 12, wherein the ferromagnetic fluid medium has a density less than all of the particles.

* * * * *